US006868913B2

(12) United States Patent
Vidrine et al.

(10) Patent No.: US 6,868,913 B2
(45) Date of Patent: Mar. 22, 2005

(54) APPARATUS AND METHODS FOR INSTALLING CASING IN A BOREHOLE

(75) Inventors: William L. Vidrine, Spring, TX (US); Tommy Grigsby, New Orleans, LA (US); Ian Phillips, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 12 days.

(21) Appl. No.: 10/262,136

(22) Filed: Oct. 1, 2002

(65) Prior Publication Data

US 2004/0060709 A1 Apr. 1, 2004

(51) Int. Cl.[7] ..... E21B 43/10
(52) U.S. Cl. ..... 166/380; 405/184
(58) Field of Search ..... 166/383, 380, 166/381, 241.1; 175/62, 321, 99; 405/174, 184

(56) References Cited

U.S. PATENT DOCUMENTS

| | | | | | |
|---|---|---|---|---|---|
| 3,799,277 | A | | 3/1974 | Kellner | 175/94 |
| 4,095,655 | A | * | 6/1978 | Still | 175/19 |
| 4,164,980 | A | | 8/1979 | Duke | 166/291 |
| 4,401,170 | A | * | 8/1983 | Cherrington | 175/73 |
| 4,532,995 | A | | 8/1985 | Kaufman | 166/327 |
| 4,674,914 | A | * | 6/1987 | Wayman et al. | 405/184.3 |
| 5,205,365 | A | * | 4/1993 | Quintana | 175/97 |
| 5,211,510 | A | * | 5/1993 | Kimura et al. | 405/184 |
| 5,215,151 | A | | 6/1993 | Smith et al. | 175/45 |
| 5,311,952 | A | | 5/1994 | Eddison et al. | 175/61 |
| 5,311,954 | A | * | 5/1994 | Quintana | 175/61 |
| 5,318,118 | A | | 6/1994 | Duell | 166/202 |
| 5,343,965 | A | * | 9/1994 | Talley et al. | 175/62 |
| 5,394,951 | A | | 3/1995 | Pringle et al. | 175/61 |
| 5,497,707 | A | | 3/1996 | Box | 104/138.2 |
| 5,601,025 | A | | 2/1997 | Box | 104/138.2 |
| 5,662,020 | A | | 9/1997 | Morita et al. | 91/44 |
| 5,713,422 | A | | 2/1998 | Dhindsa | 175/27 |
| 5,894,897 | A | | 4/1999 | Vail, III | 175/318 |
| 5,918,677 | A | * | 7/1999 | Head | 166/380 |
| 5,964,297 | A | | 10/1999 | Edman | 166/380 |
| 6,003,606 | A | | 12/1999 | Moore et al. | 166/381 |
| 6,056,053 | A | | 5/2000 | Giroux et al. | 166/155 |
| 6,223,823 | B1 | | 5/2001 | Head | 166/290 |
| 6,296,066 | B1 | | 10/2001 | Terry et al. | 175/92 |

FOREIGN PATENT DOCUMENTS

| | | | |
|---|---|---|---|
| WO | WO 97/08418 | 6/1997 | E21B/4/18 |

OTHER PUBLICATIONS

SPE Petroleum Conference (SPE 028871); *Well Tractors for Highly Deviated and Horizontal Wells;* J. Hallundback; Oct. 25–27, 1994; (pp. 57–62).

SPE/IADC Drilling Conference (SPE 37656); *Extending the Reach of Coiled Tubing Drilling* (*Thrusters, Equalizers, and Tractors*); J. Leising, E.C. Onyia, S.C. Townsend, et al Mar. 4–6, 1997; (pp. 1–14).

The Natural Selection Research Group; *Inchworm Mobility—Stable, Reliable and Inexpensive*; A. Ferworn, D. Stacey; (pp. 1–4); Undated.

CSIRO–UTS Electrical Machines; *Oil Well Tractor;* (pp. 1); undated.

Scandinavian Oil–Gas Magazine; *Well Tractor for use in Deviated and Horizontal Wells;*F. Schüssler; (pp. 1–3) Undated.

* cited by examiner

*Primary Examiner*—David Bagnell
*Assistant Examiner*—Daniel P. Stephenson
(74) *Attorney, Agent, or Firm*—Conley Rose, P.C.

(57) ABSTRACT

An apparatus and method of installing a casing string in a borehole, the apparatus comprising a propulsion system movable through the borehole; the propulsion system comprising an attachment member; and the attachment member being engagable with the casing string causing the casing string to move with the propulsion system through the borehole. The apparatus further including a conduit for circulating fluids through the propulsion system to provide the power to move the propulsion system. The propulsion system may also be disposable.

17 Claims, 4 Drawing Sheets

APPARATUS AND METHODS FOR INSTALLING CASING IN A BOREHOLE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The embodiments relate generally to methods and apparatus for movement of equipment in passages. More particularly, the embodiments relate to a propulsion system for pulling casing into boreholes.

The art of drilling vertical, inclined, and horizontal boreholes plays an important role in the oil and gas industry. For example, a typical oil or gas well comprises a vertical borehole that is drilled by a rotary drill bit attached to the end of a drill string. The drill string is typically constructed of a series of connected links of drill pipe that extend between surface equipment and the drill bit. A drilling fluid, such as drilling mud, is pumped from the surface through the interior surface or flow channel of the drill string to the drill bit. The drilling fluid is used to cool and lubricate the drill bit, and remove debris and rock chips from the borehole created by the drilling process. The drilling fluid returns to the surface, carrying the cuttings and debris, through the space between the outer surface of the drill pipe and the inner surface of the borehole.

Conventional drilling often requires drilling numerous boreholes to recover hydrocarbons, such as gas and oil, or mineral deposits. For example, drilling for oil and gas usually includes drilling a vertical borehole until the reservoir is reached. The hydrocarbons are then pumped from the reservoir to the surface. As known in the industry, often a large number of vertical boreholes must be drilled within a small area to recover the hydrocarbons within the reservoir. This requires a large investment of resources and equipment and is very expensive. Additionally, the hydrocarbons within the reservoir may be difficult to recover for several reasons. For instance, the size and shape of the formation, the depth at which the hydrocarbons are located, and the location of the reservoir may make exploitation of the reservoir very difficult. Further, drilling for oil and gas located under bodies of water, such as the North Sea, often presents greater difficulties.

In order to recover hydrocarbons from these difficult to exploit reservoirs, it may be desirable to drill a borehole that is not vertically orientated. For example, the borehole may be initially drilled vertically downwardly to a predetermined depth and then drilled at an inclination to vertical to the desired target location. In other situations, it may be desirable to drill an inclined or horizontal borehole beginning at a selected depth. This allows the hydrocarbons located in difficult-to-reach locations to be recovered.

While several methods of drilling are known in the art, two frequently used methods to drill vertical, inclined, and horizontal boreholes are generally known as rotary drilling and coiled tubing drilling. In rotary drilling, a drill string, consisting of a series of connected segments of drill pipe, is lowered from the surface using surface equipment such as a derrick and draw works. Attached to the lower end of the drill string is a bottom hole assembly ("BHA"). The BHA typically includes a drill bit and may include other equipment known in the art such as drill collars, stabilizers, and heavy-weight pipe. The other end of the drill string is connected to a rotary table or top drive system located at the surface. The top drive system rotates the drill string, the BHA, and the drill bit, allowing the rotating drill bit to penetrate into the formation. The direction of the rotary drilled borehole can be gradually altered by using known equipment such as a downhole motor with an adjustable bent housing to create inclined and horizontal boreholes.

Another type of known drilling is coiled tubing drilling. In coiled tubing drilling, the drill string tubing is fed into the borehole by an injector assembly. In contrast to rotary drilling, the drill string is not rotated. Instead, a downhole motor as part of the BHA provides rotation to the drill bit. Because the coiled tubing is not rotated or used to force the drill bit into the formation, the strength and stiffness of the coiled tubing is typically much less than that of the drill pipe used in comparable rotary drilling. Thus, the thickness of the coiled tubing is generally less than the drill pipe thickness used in rotary drilling, and the coiled tubing generally cannot withstand the same rotational and tension forces in comparison to the drill pipe used in rotary drilling.

The use of coiled tubing drilling typically eliminates the use of conventional rigs and conventional drilling equipment. See for example U.S. Pat. Nos. 5,215,151; 5,394,951 and 5,713,422, all hereby incorporated herein by reference. The BHA may also include a propulsion system that propels the bit down the borehole. One such propulsion system is a thruster that pushes off the lower terminal end of the coiled tubing and does not rely upon contacting or gripping the inside wall of the borehole.

Another such self-propelled propulsion system is manufactured by Western Well Tool. The propulsion system includes an upper and lower housing with a packerfoot mounted on each end. Each housing has a hydraulic cylinder and ram for moving the propulsion system within the borehole. The propulsion system operates by the lower packerfoot expanding into engagement with the wall of the borehole with the ram in the lower housing extending in the cylinder to force the bit downhole. Simultaneously, the upper packerfoot contracts and moves to the other end of the upper housing. Once the ram in the lower housing completes its stroke, then the hydraulic ram in the upper housing is actuated to propel the bit and motor further downhole as the lower packerfoot contracts and resets at the other end of the lower housing. This cycle is repeated to continuously move the BHA within the borehole. The propulsion system can propel the BHA in either direction in the borehole. Flow passages are provided between the packer-feet and housings to allow the passage of drilling fluids through the annulus formed by the coiled tubing and borehole.

Various companies manufacture other types of self-propelled propulsion systems for propelling the bit and pulling steel coiled tubing in the well. These propulsion systems include self-propelled wheels that frictionally engage the wall of the borehole. However, there is very little clearance between the wheels of the propulsion system and the wall of the borehole and problems arise when the wheels encounter ridges or other variances in the dimensions of the wall of the borehole. Further, at times there is an inadequate frictional engagement between the wheels and the wall of the borehole to adequately propel the propulsion system.

Other companies also offer propulsion systems to "walk" the end of a wireline down a cased borehole. However, these propulsion systems engage the interior wall of a casing having a known inside dimension. One such propulsion system is manufactured by Schlumberger.

Another form of drilling is composite tubing drilling. Similar to coiled tubing drilling, a propulsion system can also be used with composite tubing to drill a borehole. An example of a drilling system using a propulsion system with composite coiled tubing is U.S. Pat. No. 6,296,066, hereby incorporated herein by reference. With composite tubing drilling, instead of using coiled metal tubing, composite coiled tubing is used as the drilling conduit for transfer of the drilling fluids. With composite tubing, the drill string is also not rotated.

For all of the methods of drilling discussed above, during the course of the drilling program, the borehole typically has one or more "casing strings" run and cemented in place. A typical drilling program first involves drilling a large diameter borehole from the earth's surface for several thousand feet. A "surface casing" string is then run into the borehole and cemented in place. After the cement in the annulus has cured or hardened, another drill bit is utilized to drill through the cement in the surface casing to drill a second and deeper borehole into the earth formations. Typically, the subsequent drill bit has a smaller diameter that the initial drill bit such that the second borehole has a smaller diameter than the diameter of the surface borehole. However, it should be appreciated that bi-center bits and wing reamers may be used to enlarge the diameter of the second borehole.

With respect to the section of borehole subsequently drilled below a surface casing, at an appropriate depth, the drilling of the borehole is discontinued and a string of pipe commonly called a casing or liner is inserted through the surface casing. As a matter of nomenclature, a liner is a string of pipe typically suspended in the lower end of the previously set casing by a liner hanger so that the lower end of the liner does not touch the bottom of the borehole and the liner thus is suspended under the tension of the pipe weight on the liner hanger. In some instances, a liner is set on the bottom of the borehole but its upper end does not extend to the earth's surface.

If the pipe set in the borehole subsequently drilled extends to the surface of the earth it is also called a casing. When the cementing operation is completed and the cement sets, there is a column of cement in the annulus of the subsequent string of pipe. The casing strings are usually comprised of a number of joints, each being on the order of forty feet long, connected to one another by threaded connections or other connection means. Also, the joints are typical metal pipes, but may also be non-metal materials such as composite tubing.

Typically, the casing string is merely gravity fed into a vertical borehole. If a top drive rig is used, the rig can hydraulically force the casing string down into the borehole. If gravity fed, however, the weight of the casing is used to install the casing in the borehole. Typically, a casing shoe is disposed on the lower end of the casing string to close off the lower end of the casing string. The casing shoe closes off the lower end of the string so that the casing then serves as a pressure vessel in which fluid pressure can be applied to help force the casing down hole. The shoe typically is bullet shaped with a spherical-type face. A float valve may be attached to the lower end of the casing that allows the fluid to pass down the casing and out through the lower end to allow fluid circulation.

The advent in recent years of highly deviated or horizontal wells in the oil and gas industry has increased both the frequency and seriousness of difficulties encountered while running borehole casing strings. Particularly, problems occur in a borehole that has an extended reach horizontal portion. Horizontal wells may be at shallow depths where the vertical portion of the well is small. With a small vertical portion, the vertical length of the casing is short whereby minimum weight is provided by the drill string to allow gravity to assist in setting the casing. In addition, in a horizontal well, the drag becomes so great on the casing string that it can no longer be forced into the borehole. Also, if a borehole has high build rates, such as 30° per hundred feet plus, there can be a wash out in the curved section. If there is a wash out, the end of the pipe may tend to bury itself into the wash out portion rather than follow the bends or curves in the borehole. Thus, the end of the pipe could dead end into one of the cavities caused by the wash out rather than make the turn in the borehole.

Another prior art solution to these problems includes floating the pipe by making the string of casing a closed vessel and either filling the casing with a low density fluid or possibly only having air in the casing. The borehole is filled with fluid to place a column on the well to maintain control. The fluid inside the casing has a lower density than the fluid forming the column in the annulus and causes the casing string to tend to be buoyant and "float" in the borehole fluid. Causing the casing string to float reduces the drag on the highly deviated borehole wall. This methodology, however, is delicate because of the collapse pressure of the casing. The casing will collapse if the pressure differential across the casing wall becomes too great. In any event, floating the casing still does not completely eliminate the drag on the casing and thus the methodology is still subject to the problems discussed above for non-floating casing.

The consequence of encountering such difficulties are, at best, delays in the schedule of the well program and, at worst, having to drill all or part of the well again. In any case, significant additional cost is involved. Thus, there exists a need for an apparatus and method of installing casing into highly-deviated and horizontal boreholes. The casing must thus be able to maneuver through curves in the borehole. The casing must also be able to be installed in boreholes of great length, in the order of 50,000 feet. The apparatus and method of installing the casing must also cost-effectively install casing into the borehole. The cost-effectiveness not only takes into consideration the resources needed to install the casing, but also the amount of time required.

Other objects and advantages of the invention will appear from the following description.

SUMMARY OF THE PREFERRED EMBODIMENTS

The preferred embodiments provide an improved method and apparatus for movement of equipment in passages. Specifically, the embodiments provide improved methods and apparatus for moving casing within a borehole.

One preferred embodiment includes an apparatus and method for moving casing into a borehole using a propulsion system. The propulsion system includes a housing comprising an upstream section with a traction module and a downstream section with a traction module. The traction modules are each connected to a ram mounted in a cylinder within one of the housing sections for propelling the housing up and down the borehole. In operation, one of the traction modules expands to engage the borehole wall ID, whether it be a cased or open borehole, while the hydraulic ram forces the housing downhole as the other traction module moves to the other end of its housing section in preparation for actuating its ram to move the housing farther downhole.

The propulsion system is not only capable of movement within the inner diameter ("ID") of the casing string, but also operates within of the inner diameter of the open borehole. Extending from the uphole end of the propulsion system is a power fluid coiled tubing. This tubing allows fluid-flow from a surface power fluid supply that powers the propulsion system as it travels downhole. The power fluid returns to the surface through the annulus formed by the casing string and cased or open borehole wall.

The upstream end of the propulsion system includes an annular shoulder projecting radially from the outside of the propulsion system. The lower, or downhole, terminal end of the casing string to be engaged by the propulsion system includes a corresponding annular collar extending radially inward on the ID of the casing. The outer diameter ("OD") of the propulsion system shoulder is greater than the ID of the casing collar such that the housing of the propulsion system can pass through the casing collar, but the propulsion system shoulder cannot. In other words, the propulsion system shoulder engages the casing collar and bears against the casing collar to pull the casing string downhole.

To install the casing string, the casing string is first inserted into the borehole as far as possible using conventional methods such as gravity feeding or "floating". Once the casing string cannot proceed further downhole, the propulsion system is inserted into the uphole end of the casing string at the surface with the power fluid coiled tubing attached. The propulsion system travels through the casing string until the propulsion system reaches the downhole end of the casing string. As the propulsion system reaches the end of the casing string, the propulsion system housing passes through the casing collar until the propulsion system shoulder on the rear of the propulsion system engages the casing collar on the end of the casing string. After the shoulder engages the collar, as the propulsion system travels further downhole, it pulls the casing string down through the borehole until the downhole end of the casing reaches the desired depth. The propulsion system is then retrieved either by reversing the propulsion system to travel back through the casing string to the surface or by rewinding the power fluid coiled tubing onto a powered tubing spool.

In another preferred embodiment, the casing string is used to supply the power fluid to the propulsion system so as to avoid the need for a power fluid coiled tubing. Further, a disposable propulsion system would be used whereby the propulsion system would be left downhole once the borehole has been completely drilled and the casing string installed. It should be appreciated that the propulsion system would be made inexpensively since it would not be retrieved. The engagement between the casing collar and propulsion system shoulder would provide an adequate seal so as to direct the power fluid through the propulsion system and drive the system. The pressure of the power fluid against the propulsion system shoulder assists in the sealing engagement. This preferred embodiment otherwise operates similarly to the first preferred embodiment and saves the cost of a power fluid coiled tubing and the time required to retrieve the propulsion system from the borehole.

Various methods may be used to add a new section of casing to the casing string once the casing string travels far enough to add another section of casing to the casing string at the surface. One method includes disconnecting the power fluid coiled tubing from the fluid pump each time a new casing section is to be added. After the power fluid coiled tubing is disconnected, it is fed through the downhole end of the next length of casing. The casing section is then attached to the uphole end of the casing in the borehole. The power fluid coiled tubing is then re-connected to the fluid pump and the installation process is re-commenced. Another method includes threading the power fluid coiled tubing through multiple casing sections to later be added to the casing string. As new casing sections are required, the next casing section threaded onto the power fluid coiled tubing is attached to the casing string. If all of the threaded casing sections have been added to the casing string, then the power fluid coiled tubing is disconnected to thread additional casing sections. Still another method includes removing the propulsion system from the borehole to the surface each time it is necessary to add a new casing section and then re-inserting the propulsion system into the casing string to travel back downhole to continue pulling the casing string into the borehole. It should be appreciated that other methods may be used to add new casing sections.

New casing sections are added until the casing string reaches the bottom of the newly drilled borehole. Once the casing is installed in the borehole, the propulsion system is then retrieved back uphole, through the casing string to the surface where it is removed from the casing string.

Still another preferred embodiment includes installing multiple casing strings into a newly drilled borehole. This embodiment is particularly advantageous when the horizontal portion of the borehole is very long and the propulsion system cannot install the entire length of the casing string in the new borehole. In this embodiment multiple lengths of casing string are installed such as for example a first casing length and a second casing length. The second casing length would have a smaller diameter than the first length so that the second casing length would pass through the first casing length.

The first casing length includes a downhole connection on its lower terminal end which also serves as a casing collar. The second casing length, in addition to the casing collar described above, also includes a snap collar or other similar uphole connection on the upstream end of the second casing length. The propulsion system shoulder bears against the casing collar on the lower end of the first casing length to pull the first casing length downhole. After the first casing length has reached the desired depth, the propulsion system is then pulled out of the borehole.

The second casing length is then run into the borehole using the propulsion system. The propulsion system shoulder bears on the casing collar on the lower end of the second casing length. The propulsion system pulls the second casing length through the first casing length until the second casing length reaches its desired depth and the uphole connection on the second casing length stab-connects with the downhole connection on the downstream end of the first casing length, thus connecting the first casing length with the second casing length. The propulsion system is then retrieved from the borehole and an additional casing length installed as necessary. This process is repeated until the entire horizontal borehole is lined with a length of casing. Thus, the casing string is run in lengths until the all the casing has been installed.

Thus, the preferred and alternative embodiments comprise a combination of features and advantages that enable them to overcome various problems of prior devices. The various characteristics described above, as well as other features, will be readily apparent to those skilled in the art upon reading the following detailed description of the preferred and alternative embodiments, and by referring to the accompanying drawings.

BRIEF DESCRIPTION OF THE DRAWINGS

For a more detailed description of the preferred and alternative embodiments, reference will now be made to the accompanying drawings, wherein.

DETAILED DESCRIPTION OF THE PREFERRED EMBODIMENT

Figure 1:
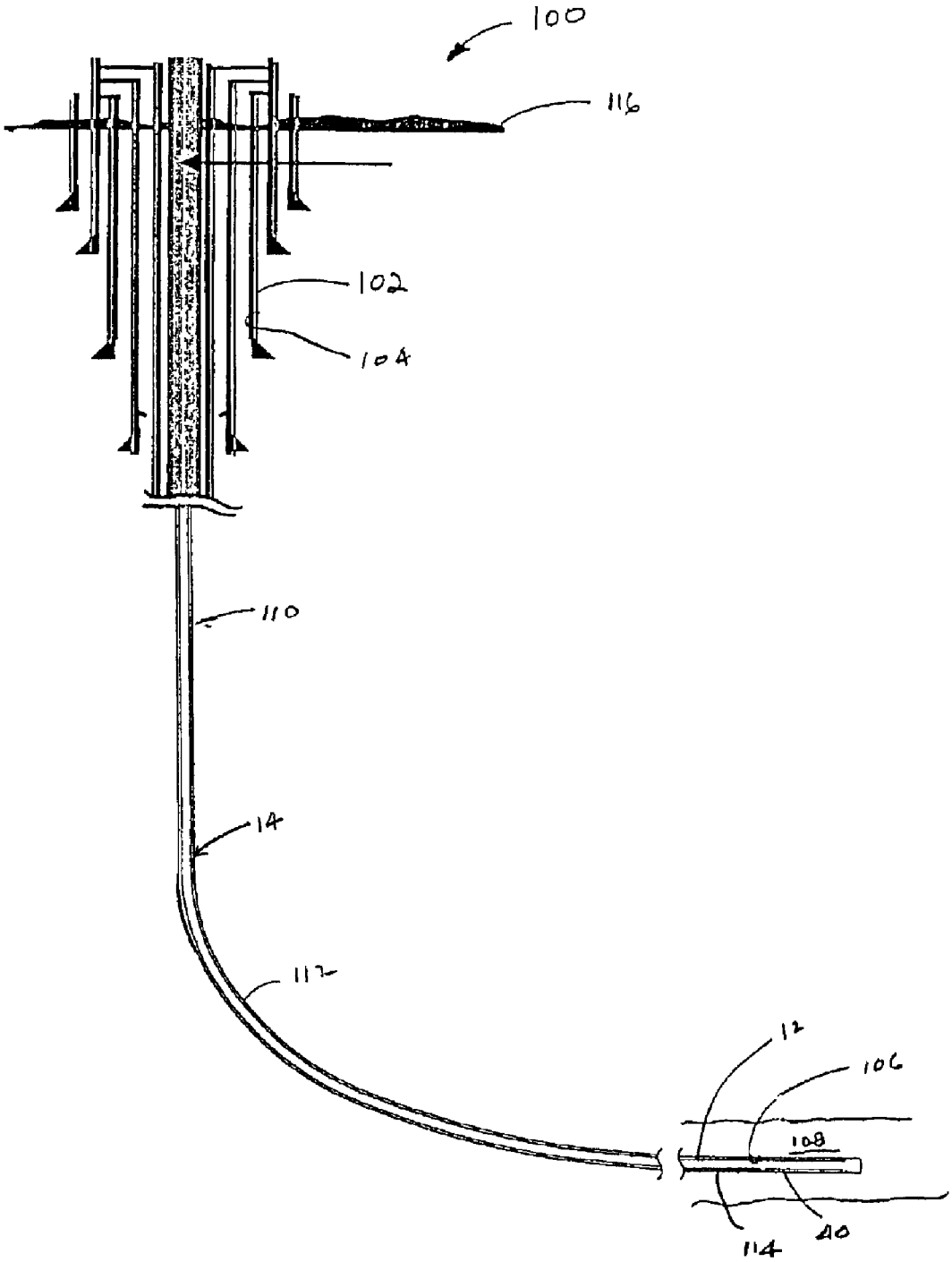
FIG. 1 is a schematic view of a conventional land well casing architecture.

While preferred embodiments of this invention are shown and described, modifications thereof can be made by one skilled in the art without departing from the spirit or teaching of this invention. The embodiments described herein are exemplary only and are not limiting. Many variations and modifications of the apparatus and methods are possible and are within the scope of the invention. Accordingly, the scope of protection is not limited to the embodiments described herein, but is only limited by the claims that follow, the scope of which shall include all equivalents of the subject matter of the claims.

In the description that follows, like parts are marked throughout the specification and drawings with the same reference numerals, respectively. The drawing figures are not necessarily to scale. Certain features may be shown in exaggerated in scale or in somewhat schematic form and some details of conventional elements may not be shown in the interest of clarity and conciseness. For example, standard fluid sealing techniques, such as the use of annular O-ring seals, and threaded connections may be depicted but not described in detail herein, as such techniques are well known in the art. As such, construction details are not important to operation of the embodiments, and are well understood by those of skill in the art, they will not be discussed here. In using the terms "above", "up", "upward", "uphole" or "upper" with respect to a member in the well bore, such member is considered to be at a shorter distance from the surface through the bore hole than another member which is described as being "below", "down", "downward", "downhole", or "lower". It should also be appreciated that the use of the term "casing" throughout this application also includes liners or any other form of tubular member.

Referring initially to FIG. 1, a typical well 100 is shown. The well 100 includes sections of structural casing 102 extending into concentric boreholes 104 with each of the structural casing 102 having decreasing diameters. The sections of structural casing 102 extend to varying depths according to the design of the well 100 and particularly to the different formations through which the boreholes extend. Once the structural casing 102 is in place, a further borehole 106 is drilled to the reservoir 108.

Directional drilling methods known in the art allow the well to be drilled in a deviated direction from vertical to deviated. This type of well is referred to as a "deviated" borehole. In addition, the borehole can deviate from vertical to such an extent as to run horizontally for some distance. This type of borehole is referred to as a "horizontal" borehole. It should also be appreciated that a borehole can have more than one deviation, or curve, and can thus comprise any number shapes as it travels into the earth. The well 100 includes a borehole 14 having a vertical portion 110 and a deviated portion 112 with the deviated portion 112 having a horizontal portion 114. A completions casing 12 is installed that extends from the surface 116 to the reservoir 108. The completions casing 12 forms an annulus 40 with the wall of the borehole.

Figure 2:
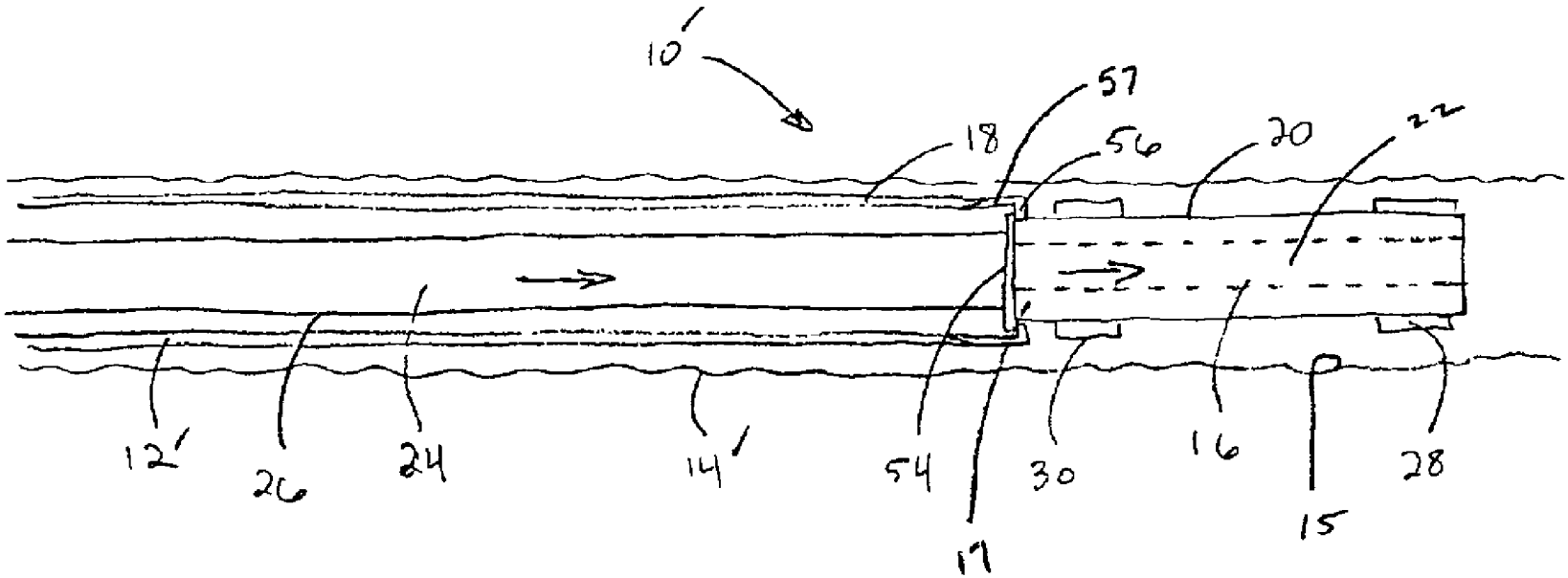
FIG. 2 is a schematic view of one preferred embodiment of a propulsion system engaged with an end of a casing string.

Referring now to FIG. 2, one preferred embodiment includes an apparatus 10 for installing casing 12 within borehole 14. The apparatus 10 includes a propulsion system 16 comprising one end, such as uphole end 17, attached to the lower end of a power fluid coiled tubing 26. The upper end of the power fluid coiled tubing 26 is attached to a power fluid pump (not shown) at the surface 116. Power fluid coiled tubing 26 may be metal coiled tubing or preferably composite coiled tubing 26. Power fluid coiled tubing 26 allows fluid-flow from the surface 116 to the propulsion system 16 that powers the propulsion system 16 as it travels within borehole 14. Propulsion system 16 includes a housing 20 with a flow bore 22 therethrough for the fluids flowing down through the flowbore 24 of power fluid coiled tubing 26 extending from the uphole end 17 of the propulsion system 16. The propulsion system 16 engages the completion casing 12, as hereinafter decried, for propelling the casing 12 downhole.

Figure 3:
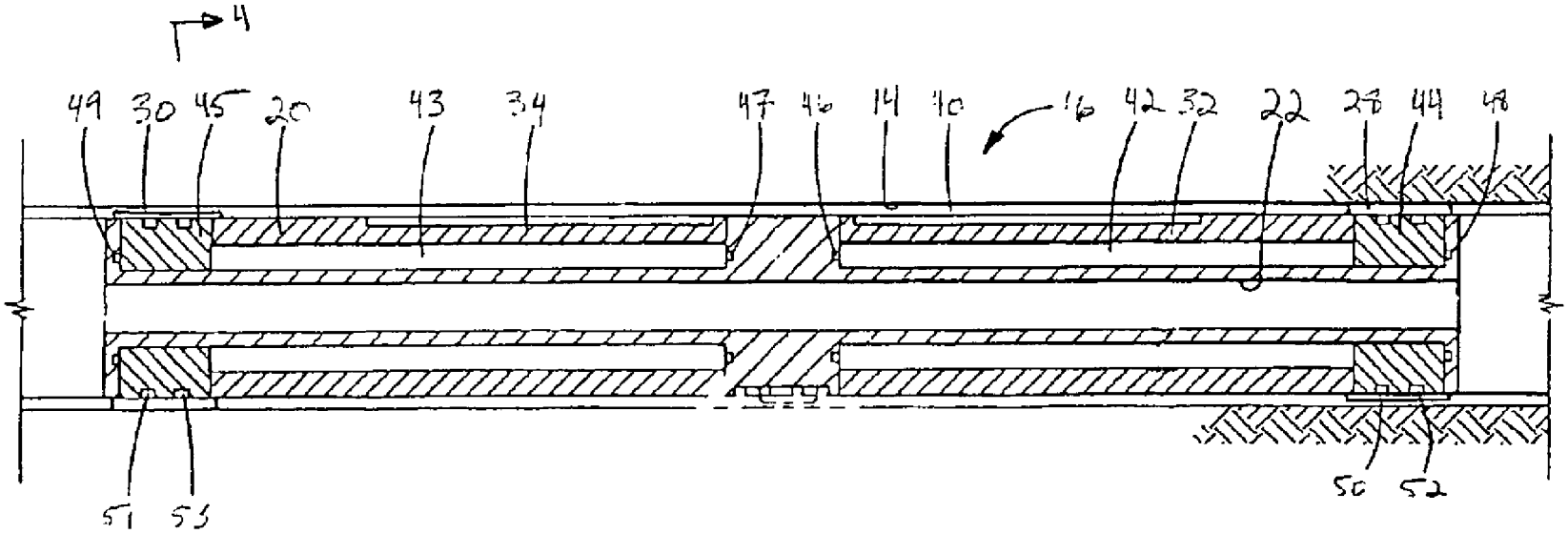
FIG. 3 is a cross-sectional view of the propulsion system of FIG. 2.
Figure 4:
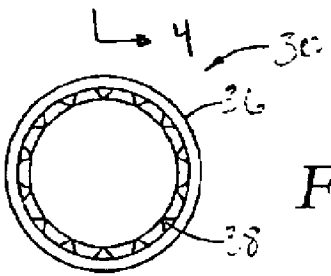
FIG. 4 is a cross-sectional view taken at plane 4—4 in FIG. 3 showing one of the traction modules.

Referring now to FIGS. 3 and 4, there is shown a schematic of a typical propulsion system 16. For self-propulsion, propulsion system 16 becomes the prime mover and includes a downstream packer-like traction module 28 and an upstream packer-like traction module 30. It should be appreciated that the propulsion system 16 may include more than two traction modules. Housing 20 of propulsion system 16 includes a downstream section 32 and an upstream section 34.

As best shown in FIG. 4, there is shown a cross-section of traction module 30. Because the traction modules 28, 30 are similar in construction, a description of one traction module approximates the description of the other. Traction module 30 includes steel feet 36 around its outer circumference that may be expanded and contracted into engagement with the wall 15 of borehole 14. A plurality of flutes or longitudinal fluid flow passages 38 are provided around the inner circumference of the steel bands forming feet 36 to allow fluid to flow upstream through annulus 40 when traction module 30 is expanded into engagement with the wall 15 of borehole 14. The traction modules 28, 30 may comprise independently inflatable, individual chambers, as hereinafter described in detail, for expanding modules 28, 30 eccentrically with respect to the housing 20.

Downstream housing section 32 includes a tubular cylinder 42 in which is disposed a hydraulic ram 44 on which is mounted downstream traction module 28. Hydraulic ports 46, 48 are disposed at the opposite ends of tubular cylinder 42 for applying hydraulic pressure to ram 44. Hydraulic ports 50, 52 are disposed adjacent downstream traction module 28 for expanding and contracting the traction module in and out of engagement with the wall of borehole 12. It should be appreciated that upstream housing section 20 is similar in construction and operation with cylinder 43, ram 45, and ports 47, 49, 51, and 53. It should also be appreciated that propulsion system 16 includes a series of valves using fluid pressure for the actuation of rams 44, 45 and traction modules 28, 30 mounted on rams 44, 45, respectively.

The cycle of propulsion system 16 includes expanding downstream traction module 28 into engagement with the interior wall 15 of borehole 14 with the upstream traction module 30 in the contracted and non-engaged position as shown in FIG. 3. Hydraulic pressure is applied through hydraulic ports 48, thus applying pressure to ram 44. As pressure is applied against ram 44, which is stationary relative to the borehole 14 due to its attachment to engaged traction module 28, housing 20 moves downhole. Hydraulic fluid is simultaneously applied through hydraulic port 49 causing contracted upstream traction module 30 to move forward on upstream housing section 34. Upstream traction module 30 thus moves forward simultaneously with housing 20 moving downhole. Once the downstream traction module 28 reaches the upstream end of tubular cylinder 42, it has completed its forward stroke and is contracted. Simultaneously, upstream traction module 30 has now completed its travel to the downstream end of tubular cylinder 43 and it is in its reset position to start its downward stroke. Traction module 30 is then expanded into engagement with borehole 14. As hydraulic pressure is applied through hydraulic port 47 and against upstream ram 45, propulsion system 16 strokes downwardly. Simultaneously, downstream traction module 28 is contracted and reset by applying hydraulic pressure through upstream port 46. The cycle is then repeated allowing the propulsion system 16 to move continuously downstream in one fluid motion. Each stroke approximates the length of housing sections 32, 34. It should be appreciated that the propulsion system 16 is not only capable of movement within the borehole 14, but also is capable of operating within the ID of the structural casing 12 or any other casing already in place in the borehole 14. The propulsion system 16 has this ability due to the expansion and contraction of the traction modules 28, 30.

It should be appreciated that the hydraulic actuation may be reversed whereby propulsion system 16 may be moved upstream in borehole 14. In other words, propulsion system 16 can "walk" either forward, downstream, or backward, upstream in borehole 14. It also should be appreciated that although propulsion system 16 is shown as being hydraulically actuated, it may also be operated electrically with power being provided through power transmission conductors.

It should also be appreciated that although the propulsion system 16 has been described with two traction modules, the propulsion system 16 may be configured with additional traction modules, such as three traction modules, depending upon the application.

Western Well Tool, Inc. manufactures a preferred propulsion system having expandable and contractible upstream and downstream traction modules mounted on a hydraulic ram and cylinder for self-propelling drilling bits. The Western Well Tool propulsion system is described in a European patent application PCT/US96/13573 filed Aug. 22, 1996 and published Mar. 6, 1997, publication No. WO 97/08418, hereby incorporated herein by reference.

Other propulsion systems may be adapted for use with the preferred embodiment. Other types of propulsion systems include an inchworm by Camco International, Inc., U.S. Pat. No. 5,394,951, hereby incorporated herein by reference and by Honda, U.S. Pat. No. 5,662,020, hereby incorporated herein by reference. See also U.S. Pat. No. 3,799,277, hereby incorporated herein by reference. Also, robotic propulsion systems are produced by Martin Marietta Energy Systems, Inc. and are disclosed in U.S. Pat. Nos. 5,497,707 and 5,601,025, each hereby incorporated herein by reference. Another company manufactures a propulsion system that it calls a "Helix". See also "Inchworm Mobility—Stable, Reliable and Inexpensive," by Alexander Ferwom and Deborah Stacey; "Oil Well Tractor" by CSIRO-UTS of Australia; "Well Tractor for Use in Deviated and Horizontal Wells" by Fredrik Schussler; "Extending the Reach of Coiled Tubing Drilling (Thrusters, Equalizers, and Tractors)" by L. J. Leising, E. C. Onyia, S. C. Townsend, P. R. Paslay and D. A. Stein, SPE Paper 37656, 1997, all hereby incorporated herein by reference. See also "Well Tractors for Highly Deviated and Horizontal Wells", SPE Paper 28871 presented at the 1994 SPE European Petroleum Conference, London Oct. 25–27, 1994, hereby incorporated herein by reference.

Referring again to FIG. 2, the upstream end 17 of the propulsion system 16 includes an attachment member for attaching the propulsion system 16 to the casing 12. In one preferred embodiment, the propulsion system attachment member is an annular shoulder 54 extending radially outward from the outside of uphole end 17 of housing 20 of the propulsion system 16. The lower, or downhole, end of casing 12 also includes an attachment member. In one preferred embodiment, the casing attachment member is an annular collar 56 on the ID of the casing 12. The annular collar 56 has a inner diameter greater than the outer diameter of housing 20 such that housing 20 will pass through the annular collar 56. The OD of the propulsion system shoulder 54 is greater than the ID of the casing collar 56 such that the housing 20 of propulsion system 16 can pass through the casing collar 56, but the propulsion system shoulder 54 cannot such that propulsion system shoulder 54 bears against casing annular collar 56.

It should be appreciated that casing annular collar 56 may be affixed to the end of casing 12 in various manners. In one embodiment, annular collar 56 is part of a sub 57 threaded onto the lowermost section of casing 12 making up the casing string. Annular collar 56 must be strong enough to withstand the forces to be applied to it by propulsion system 16 to pull the casing string into the borehole 14.

It should be appreciated that the annular shoulder 54 on propulsion system 16 may be removable from housing 20. For example, annular shoulder 54 may be threaded onto housing 20. Another example includes mounting the annular showered 54 on the connection between the power fluid coiled tubing 26 and housing 20 of the propulsion system 16. This will allow annular shoulders 54 with different outside diameters to be mounted on propulsions system 16 to accommodate the size of the casing 12 being installed.

In accordance with the preferred methods of operation, the casing string 12 is first installed into the borehole 14 as far as possible using conventional methods such as gravity feeding or "floating". Once the casing string 12 cannot proceed further downhole, the propulsion system 16 is inserted into the uphole end of the casing string 12 at the surface 116 with the power fluid coiled tubing 26 attached. The propulsion system 16 travels through the interior of the casing string 12 until the propulsion system 16 reaches the downhole end 18 of the casing string 12. As the propulsion system 16 reaches the end 18 of the casing string 12, the propulsion system housing 20 passes through the ID of casing collar 56 until the propulsion system shoulder 54 engages the casing collar 56. After the shoulder 54 engages the collar 56, as the propulsion system 16 travels further downhole, it pulls the casing string 12 further down through the borehole 14. This is particularly advantageous in installing the casing string 12 in a highly deviated borehole 112 and most advantageous in a horizontal portion 114 of the borehole 14.

The propulsion system 16 then travels further downhole, pulling the casing string 12 down through the borehole 14 until the downhole end 18 of the casing string 12 reaches the desired depth. The propulsion system 16 is then retrieved either reversing the propulsion system 16 to travel back through the casing string 12 to the surface 116 or by rewinding the power fluid coiled tubing 26 onto a powered tubing spool.

Figure 5:
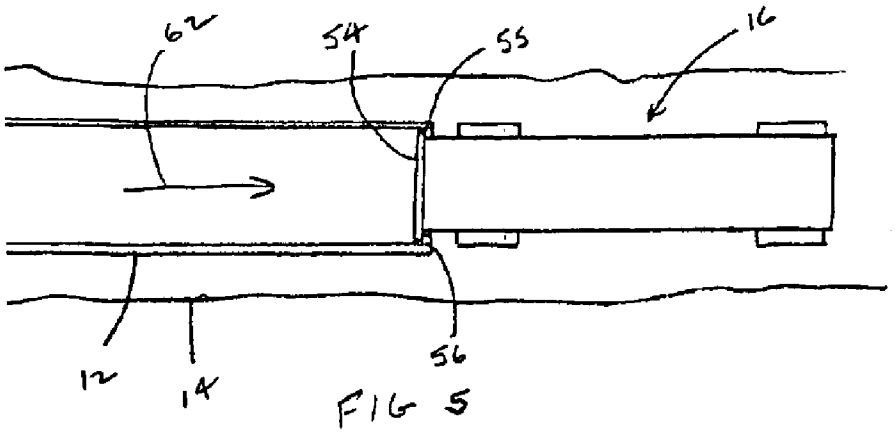
FIG. 5 is a schematic view of another preferred embodiment of the propulsion system using the casing string as the means for providing power fluid to the propulsion system.

Referring now to FIG. 5, there is shown another preferred embodiment. In this embodiment, the casing string 12 is used to supply the power fluid to the propulsion system 16 so as to avoid the need for a power fluid coiled tubing. Further, a disposable propulsion system would be used whereby the propulsion system 16 would be left downhole once the borehole 14 has been completely drilled and the casing string 12 installed. It should be appreciated that the propulsion system 12 would be made inexpensively because it would not be retrieved. The engagement at 55 between the casing collar 56 and propulsion system shoulder 54 would provide an adequate seal so as to direct the power fluid 62 through the propulsion system 16 and drive the system. The pressure of the power fluid 62 against the propulsion system shoulder 54 assists in the sealing engagement at 55. This preferred embodiment otherwise operates similarly to the first preferred embodiment and saves the cost of a power fluid coiled tubing and the time required to retrieve the propulsion system from the borehole.

Once the casing string 12 travels far enough to add on more sections of casing, the propulsion system 16 stops, reverses, and then travels back uphole to the surface 108 where it is retrieved from the casing string 12. As many sections of casing as can be handled on the surface 108 are then added to the casing string 12. The propulsion system 16 is then re-inserted into the casing string 12 and the process is repeated until the casing string 12 reaches the reservoir 106. Once the casing 12 is installed in the borehole 14, the propulsion system 16 then travels uphole, back through the casing 12 to the surface 108 where it is retrieved from the casing string 12.

Various methods may be used to add a new section of casing to the casing string 12 once the casing string 12 travels far enough to add another section of casing to the casing string 12 at the surface 116. One method includes disconnecting the power fluid coiled tubing 26 from the fluid pump each time a new casing section is to be added. After the power fluid coiled tubing 26 is disconnected, it is fed through the downhole end of the next length of casing 12. The casing section is then attached to the uphole end of the casing string 12 in the borehole 14. The power fluid coiled tubing 26 is then re-connected to the fluid pump and the installation process is re-commenced.

Another method includes threading the power fluid coiled tubing 26 through multiple casing sections to later be added to the casing string 12. As new casing sections are required, the next casing section, threaded onto the power fluid coiled tubing 26, is attached to the casing string 12. If all of the threaded casing sections have been added to the casing string 12, then the power fluid coiled tubing 26 is disconnected to thread additional casing sections.

Still another method includes removing the propulsion system 16 from the borehole 14 to the surface 116 each time it is necessary to add a new casing section and then re-inserting the propulsion system 16 into the casing string 12 to travel back downhole to continue pulling the casing string 12 into the borehole 14. It should be appreciated that other methods may be used to add new casing sections.

New casing sections are added until the casing string 12 reaches the bottom of the newly drilled borehole 14. Once the casing 12 is installed in the borehole 14, the propulsion system 16 is then retrieved back uphole, through the casing string 12 to the surface 116 where it is removed from the casing string 12.

Figure 6:
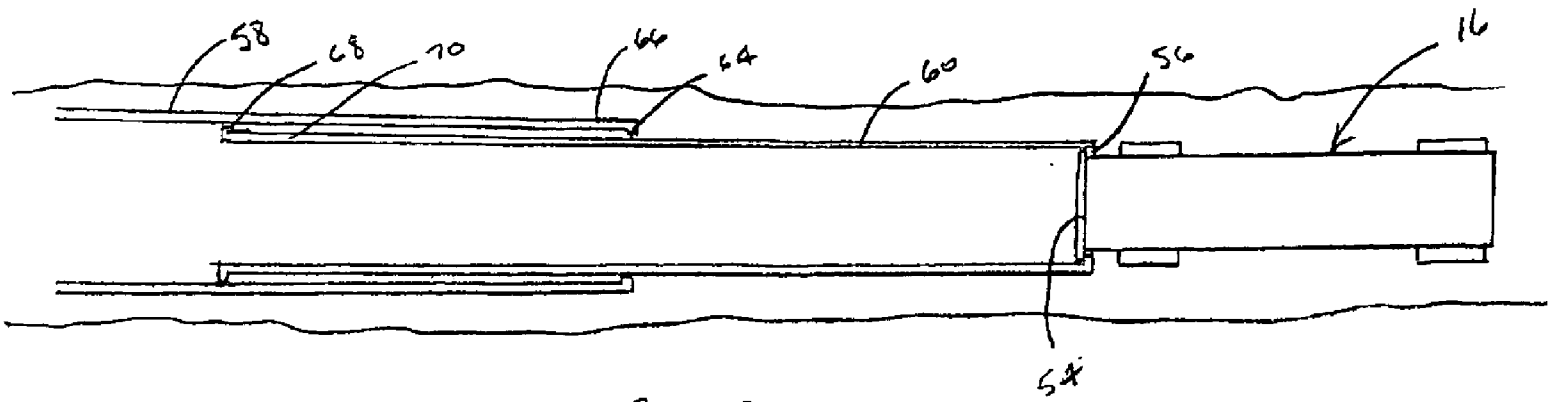
FIG. 6 is a schematic view of a still another preferred embodiment of a propulsion system engaged with an end of a casing length that is to be joined with the a previously installed casing length.

Referring now to FIG. 6, still another preferred embodiment includes installing multiple casing strings into a newly drilled borehole. This embodiment is particularly advantageous when the horizontal portion of the borehole is very long and the propulsion system cannot install the entire length of the casing string in the new borehole at one time. In this embodiment, multiple lengths, such as first casing length 58 and second casing length 60, of the casing string are installed. The second casing length 60 has a smaller diameter than the first length 58 so that the second casing length 60 can pass through the first casing length 58.

The first casing length 58 includes a downhole connection 64 on its lower terminal end 66, which also serves as a casing collar. The second casing length 60, in addition to the casing collar described above, also includes a snap collar or other similar uphole connection 68 on the upstream end 70 of the second casing length 60.

In operation, initially the first casing length 58 is installed in the borehole 14 as previously described. The propulsion system shoulder 54 bears against the casing collar connection 64 on the lower end 66 of the first casing length 58 to pull the first casing length 58 downhole. After the first casing length 58 has reached the desired depth, the propulsion system 16 is then pulled out of the borehole 14.

The annular shoulder 54 on propulsion system 16 may be changed to an annular shoulder 54 which has a smaller outside diameter to accommodate the smaller diameter second casing length 60. The second casing length 60 is then run into the borehole 14 through the first casing length 58 using the propulsion system 16. The propulsion system shoulder 54 bears on the casing collar 56 on the lower end of the second casing length 60. The propulsion system 16 pulls the second casing length 60 through the first casing length 58 until the second casing length 60 reaches its desired depth and the uphole connection 68 on the second casing length 60 stab-connects with the downhole connection 64 on the downstream end 66 of the first casing length 58, thus connecting the first casing length 58 with the second casing length 60. The propulsion system 16 is then retrieved from the borehole 18 and an additional casing length is installed as necessary. This process is repeated until the entire horizontal borehole 114 is lined with a length of casing. Thus, the casing string is run in lengths until the all the casing has been installed.

While preferred embodiments of the invention have been shown and described, modifications can be made by one skilled in the art without departing from the spirit of the invention.

What is claimed is:

1. A method of installing a casing string in a borehole, the method comprising:

inserting a propulsion system into the casing string;

engaging the casing string by the propulsion system;

powering the propulsion system to travel through the borehole; and pulling the casing string into the borehole with the propulsion system.

2. The method of claim 1 further comprising engaging an extension of the casing string with an extension on the propulsion system causing the casing string to move downhole with the propulsion system.

3. The method of claim 1 further comprising passing fluids through the casing string and propulsion system to power the propulsion system.

4. The method of claim 1 further comprising removing the propulsion system casing string.

5. The method of claim 1 further comprising circulating power fluid through a coiled tubing connected to the propulsion system to provide power to the propulsion system.

6. The method of claim 1 further comprising adding additional sections of casing to the casing string.

7. The method of claim 6 further including threading the coiled tubing through a plurality of new casing sections and adding a new casing section as needed.

8. The method of claim 6 further including removing the propulsion system from the borehole, attaching at least one new casing section to the casing string, engaging the propulsion system with the casing string, and pulling the casing string and at least one additional casing section downhole with the propulsion system until the casing string reaches a predetermined depth.

9. The method of claim 1 further comprising connecting a coiled tubing to a power fluid source and circulating power fluid through the coiled tubing connected to the propulsion system to provide power to the propulsion system.

10. The method of claim 9 further including disconnecting the coiled tubing from the fluid power source and attaching at east one new section of casing to the casing string.

11. The method of claim 10 further comprising adding additional sections of casing until the casing string is completely installed in the borehole.

12. The method of claim 1 further comprising projecting the propulsion system out of the lower end of the casing string and the propulsion system engaging the borehole wall to propel the casing string downhole.

13. A method of installing a casing string comprising at least one section of casing into a borehole comprising:

a) inserting the casing string into the borehole, the casing string having a downhole end with an extension projecting radially inward;

b) inserting a propulsion system into the casing string, the propulsion system comprising an extension projecting radially outward and being engagable with the casing string extension such that the propulsion system can move the casing string downhole within the borehole and also can move uphole relative to the casing string, the propulsion system also being powered by circulating fluids from a power fluid pump connected to the propulsion system through a power fluid conduit;

c) engaging the propulsion system extension with the casing string extension; and d) pulling the casing string downhole with the propulsion system.

14. The method of claim 13 further comprising:

a) disconnecting the power fluid conduit from the power fluid pump;

b) inserting the power fluid conduit into a downhole end of at least one additional casing section;

c) attaching the least one additional casing section to the casing string;

d) reconnecting the power fluid conduit to the power fluid pump;

e) pulling the casing string and at least one additional casing section downhole with the propulsion system; and f) repeating steps (a)–(e) until the downhole end of the casing string reaches a predetermined depth.

15. The method of claim 14 further comprising removing the propulsion system from the casing string.

16. A method of installing a casing string comprising first and second casing lengths into a borehole comprising:

a) inserting the first casing length into the borehole, the first casing length comprising a downhole end with a downhole connector comprising a first casing extension projecting radially inward;

b) inserting a propulsion system into the first casing length, the propulsion system comprising an extension projecting radially outward and being engagable with the first casing extension such that the propulsion system can move the first casing length downhole within the borehole and also move uphole relative to the casing string;

c) engaging the propulsion system extension with the first casing length extension;

d) pulling the first casing length downhole with the propulsion system until the downhole end reaches a predetermined depth;

e) removing the propulsion system from the borehole;

f) inserting the second casing length into the first casing length in the borehole, the second casing length comprising a downhole end with a second casing extension projecting radially inward and an uphole connector adapted for engagement with the downhole connector;

g) engaging the propulsion system extension with the second casing extension; and h) pulling the second casing extension downhole with the propulsion system until the up connector connects with the downhole connector.

17. The method of claim 16 further comprising removing the propulsion system from the borehole.

* * * * *